US008096373B2

(12) United States Patent
Patel et al.

(10) Patent No.: US 8,096,373 B2
(45) Date of Patent: Jan. 17, 2012

(54) ROTARY DRILL BITS AND DRILLING TOOLS HAVING PROTECTIVE STRUCTURES ON LONGITUDINALLY TRAILING SURFACES

(75) Inventors: Suresh G. Patel, The Woodlands, TX (US); Ben L. Kirkpatrick, Tyler, TX (US); Scott E. Mayer, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 184 days.

(21) Appl. No.: 12/417,104

(22) Filed: Apr. 2, 2009

(65) Prior Publication Data

US 2009/0308663 A1 Dec. 17, 2009

Related U.S. Application Data

(60) Provisional application No. 61/042,528, filed on Apr. 4, 2008.

(51) Int. Cl.
*E21B 10/36* (2006.01)

(52) U.S. Cl. ..... 175/431; 175/426

(58) Field of Classification Search ..... 175/374, 175/425, 434, 426, 431
See application file for complete search history.

(56) References Cited

U.S. PATENT DOCUMENTS

| | | | | |
|---|---|---|---|---|
| 4,512,425 | A * | 4/1985 | Brock | 175/430 |
| 4,554,986 | A * | 11/1985 | Jones | 175/397 |
| 4,591,008 | A | 5/1986 | Oliver | |
| 4,943,488 | A | 7/1990 | Sung et al. | |
| 5,049,164 | A | 9/1991 | Horton et al. | |
| 5,289,889 | A * | 3/1994 | Gearhart et al. | 175/325.5 |
| 5,415,243 | A * | 5/1995 | Lyon et al. | 175/331 |
| 5,755,297 | A * | 5/1998 | Young et al. | 175/331 |
| 6,173,797 | B1 | 1/2001 | Dykstra et al. | |
| 6,206,117 | B1 * | 3/2001 | Tibbitts et al. | 175/399 |
| 6,227,314 | B1 * | 5/2001 | Zadrapa et al. | 175/331 |
| 6,290,007 | B2 | 9/2001 | Beuershausen et al. | |
| 6,321,862 | B1 | 11/2001 | Beuershausen et al. | |
| 6,349,780 | B1 * | 2/2002 | Beuershausen | 175/408 |

(Continued)

FOREIGN PATENT DOCUMENTS

EP 0246789 A2 11/1987

OTHER PUBLICATIONS

PCT International Search Report for International Application No. PCT/US2009/039265, mailed Oct. 26, 2009.

(Continued)

*Primary Examiner* — Daniel P Stephenson
(74) *Attorney, Agent, or Firm* — TraskBritt

(57) ABSTRACT

A rotary drill bit or other drilling tool for drilling or reaming through subterranean formation and comprising a body comprising a distal end and gage areas near a proximal end thereof and comprising longitudinally upward extensions of a plurality of blades or legs. A longitudinally trailing, radially inwardly extending surface is associated with at least some gage pads or legs at the longitudinally trailing ends thereof. Protective structures in the form of superabrasive elements comprising a plurality of thermally stable polycrystalline diamonds, or so-called "TSPs" (thermally stable products) are secured to a trailing surface of at least one gage pad. PDC elements may be employed in combination with the TSPs. Non-diamond structures may also be employed, in lieu of or in conjunction with diamond structures, particularly if drilling of ferrous metal casing components is contemplated.

16 Claims, 6 Drawing Sheets

U.S. PATENT DOCUMENTS

| | | | | |
|---|---|---|---|---|
| 6,619,412 | B2 * | 9/2003 | Slaughter et al. | 175/228 |
| 6,763,902 | B2 | 7/2004 | Larsen et al. | |
| 7,143,847 | B2 * | 12/2006 | Pia | 175/263 |
| 7,513,318 | B2 * | 4/2009 | Underwood et al. | 175/61 |
| 2007/0205023 | A1 | 9/2007 | Hoffmaster et al. | |
| 2008/0223619 | A1 | 9/2008 | Overstreet et al. | |
| 2008/0230278 | A9 | 9/2008 | Hoffmaster et al. | |
| 2008/0251297 | A1 * | 10/2008 | Overstreet et al. | 175/374 |

OTHER PUBLICATIONS

PCT Written Opinion for International Application No. PCT/US2009/039265, mailed Oct. 26, 2009.

* cited by examiner

ROTARY DRILL BITS AND DRILLING TOOLS HAVING PROTECTIVE STRUCTURES ON LONGITUDINALLY TRAILING SURFACES

CROSS-REFERENCE TO RELATED APPLICATION

This application claims the benefit of U.S. Provisional Patent Application Ser. No. 61/042,528, filed Apr. 4, 2008, and entitled ROTARY DRILL BITS HAVING SUPERABRASIVE STRUCTURE ON LONGITUDINALLY TRAILING SURFACES, the disclosure of which patent application is incorporated herein in its entirety by reference.

TECHNICAL FIELD

The present invention, in various embodiments, relates to rotary drill bits and drilling tools for subterranean drilling and, more particularly, to rotary drill bits and drilling tools employing protective structures, which may comprise thermally stable superabrasive structures, placed on or adjacent at least one trailing surface of a body thereof extending radially inwardly from the body toward a shank or other drill string connection component. In some embodiments, non-diamond abrasive structures may be utilized, particularly where casing exit drilling or other drilling of steel components is to be effected.

BACKGROUND

Drilling wells for oil and gas production conventionally employs longitudinally extending sections, or so-called "strings," of drill pipe to which, at one end, is secured to a drill bit of a larger diameter. The drill bit conventionally forms a bore hole through the subterranean earth formation to a selected depth. Generally, after a selected portion of the bore hole has been drilled, the drill bit is removed from the bore hole so that a string of tubular members of lesser diameter than the bore hole, known as casing, can be placed in the bore hole and secured therein with cement. Therefore, drilling and casing according to the conventional process typically requires sequentially drilling the bore hole using drill string with the drill bit attached thereto, removing the drill string and drill bit from the bore hole, and disposing and cementing a casing into the bore hole.

Rotary drill bits are commonly used for drilling such bore holes or wells. One type of rotary drill bit is the fixed-cutter bit (often referred to as a "drag" bit), which typically includes a plurality of cutting elements secured to a face region of a bit body. Referring to FIG. 1, a conventional fixed-cutter rotary drill bit 100 includes a bit body 110 having a face 120 defining a distal or leading end and comprising generally radially extending blades 130, forming fluid courses 140 therebetween extending to junk slots 150 between circumferentially adjacent blades 130. Bit body 110 may comprise a composite matrix formed of hard particles such as a tungsten carbide infiltrated with a binder, conventionally of a copper alloy, a steel body, or a sintered matrix of hard particles such as a metal carbide, all as known in the art.

Some or all of blades 130 may include a gage pad 160 which is configured to define the outermost radius of the drill bit 100 and, thus, the radius of the wall surface of a bore hole drilled thereby. Gage pads 160 comprise longitudinally upward (as the drill bit 100 is oriented during use) extensions of blades 130. The gage pads 160 may have wear-resistant inserts or coatings, such as hardfacing material, on radially outer surfaces 162 thereof as known in the art to inhibit excessive wear thereto, and may also have cutting elements on rotationally leading surfaces 164 thereof to maintain the intended borehole diameter drilled by the drill bit 100.

A plurality of cutting elements 180 are conventionally positioned on each of the blades 130. Generally, the cutting elements 180 have either a disk shape or, in some instances, a more elongated, substantially cylindrical shape. The cutting elements 180 commonly comprise a "table" of superabrasive material, such as mutually bound particles of polycrystalline diamond, formed on a supporting substrate of a hard material, conventionally cemented tungsten carbide. Such cutting elements are often referred to as "polycrystalline diamond compact" (PDC) cutting elements or cutters. The plurality of PDC cutting elements 180 may be provided within cutting element pockets 190 formed in rotationally leading surfaces of each of the blades 130. Conventionally, a bonding material, such as an adhesive or, more typically, a braze alloy, may be used to secure the cutting elements 180 to the bit body 110. Of course, other drill bits configured as drag bits may employ, for example, non-diamond superabrasive cutting structures (e.g., cubic boron nitride), natural diamonds, thermally stable polycrystalline diamond elements, or "TSPs" (thermally stable products), diamond grit-impregnated matrix cutting structures, and combinations of the foregoing, including PDC cutting elements. As known to those of ordinary skill in the art, the drill bit configuration and cutting structures employed are selected in light of the formation or formations intended to be drilled.

The bit body 110 of a rotary drill bit 100 typically is secured to a hardened steel shank 200 having an American Petroleum Institute (API) thread connection for attaching the drill bit 100 to a drill string (not shown). A trailing surface 210 is located between a radially outer surface 162 of each gage pad 160 and a shoulder 220. Transition edges 230 lie at the junctions between the radially outer surfaces 162 of gage pads 160 and their associated longitudinally trailing surfaces 210. Trailing surfaces 210 may each comprise a flat bevel or chamfer, or may be somewhat arcuate. Typically, the trailing surface lies at about a 45° angle to the longitudinal axis of the bit.

During drilling operations, the drill bit 100 is positioned at the bottom of a well bore hole and rotated. Drilling fluid is pumped through passages on the interior of the bit body 110, and out through nozzles (not shown). As the drill bit 100 is rotated, the PDC cutting elements 180 scrape across and shear away the underlying earth formation material. The formation cuttings mix with the drilling fluid and pass through the junk slots 130, up through an annular space between the wall of the bore hole and the outer surface of the drill string to the surface.

When drilling in formation with unconsolidated, highly abrasive sand formations, the radially outer surfaces 162 of the gage pads 160 of the drill bits are subjected to wear caused by the abrasive cuttings being drilled, the high sand content in the mud, and the sand particles along the bore hole wall. Improvements in the wear-resistant inserts and/or coatings have helped to limit the accelerated wear from occurring on the radially outer surfaces 162 of the gage pads 160 in the normal (i.e., downward) drilling mode. However, drilling in hard rock, abrasive formations also results in accelerated wear on the trailing surfaces 210 of the gage pads 160. Further, when a drill bit 100 is rotated in the bore hole as it is withdrawn therefrom, such as when back reaming or "up-drilling" is performed, substantial wear to the trailing surfaces 210 located near the shank 200 end of the drill bit 100 may occur. Wear also occurs when back-drilling to enhance bore hole quality or to remove or remediate "dog legging" in the well bore. This type of wear causes rounding over the gage pads 160 and such wear will eventually compromise the ability of the gage pads 160 to maintain the intended gage of the bit, requiring the bit to be scrapped or, at the least, prematurely repaired.

While PDC cutting elements usable for up-drilling have been placed at the trailing ends of gage pads, such as at the junction of the radially outer surface with the longitudinally trailing surface of the gage pad, such an arrangement is not effective in preventing excess wear and PDC cutting elements alone are not particularly robust for up-drilling due to the discontinuous nature of their engagement with the wall of a previously drilled bore hole. Furthermore, PDC cutting elements are relatively expensive, several PDC cutting elements must be used to afford complete protection to the trailing surface, and PDC cutting elements must be brazed or otherwise secured to the bit body of a bit after manufacture. Thermal limitations of PDC cutting elements preclude them being furnaced into the body of a matrix-type bit during infiltration. Natural diamonds have also been placed in the same area, but the sizes and shapes of natural diamonds require the use of an excessive number of stones.

In addition, when drill bits are used in so-called "steerable" bottom hole assemblies to drill in non-linear paths such as are employed in directional and horizontal bore holes, the trailing surfaces of the gage pads are subjected to increased abrasive wear as the bit is tilted in the bore hole by the steering assembly when drilling a non-linear path.

While rotary drag bits, including full-diameter bits, core bits, bi-center bits and eccentric bits experience the above-described problems, these problems are not so limited. Roller cone bits, so-called "hybrid" bits including both fixed cutting elements and rotating cones or other structures, and other drilling tools such as, by way of non-limiting example, fixed-blade and expandable reamers, all experience similar problems on trailing surfaces of their bodies where necking down to a shank or other smaller-diameter component is used for connection to another component of a bottom hole assembly, or to the drill string itself.

BRIEF SUMMARY

Various embodiments of the present invention are directed toward a rotary fixed-cutter, or drag, drill bit for drilling through one or more subterranean formations. In one embodiment, the present invention contemplates a bit body comprising a face at a distal end and gage pads near a proximal end thereof and comprising longitudinally upward extensions of a plurality of blades. A longitudinally trailing, obliquely radially inwardly extending surface, which may also be characterized as a transition surface, is associated with at least some gage pads at the longitudinally trailing end thereof. Protective structures, which may comprise superabrasive structures in the form of a plurality of thermally stable polycrystalline diamonds, or so-called "TSPs" (thermally stable products), are secured proximate a trailing surface of at least one gage pad. In one embodiment, TSPs may be secured proximate the trailing surface of each gage pad including same. In another embodiment, TSPs may be secured proximate the trailing surfaces of some, but not all, gage pads.

In one embodiment, the TSPs may be set substantially flush with the trailing surface proximate which they are secured. In another embodiment, the TSPs may be set with a portion exposed above the trailing surface. The TSPs may be set on a trailing surface in various different exposures. In yet another embodiment, at least one TSP may be set substantially flush with the trailing surface and at least one other TSP set with a portion exposed. If exposed, the TSP may be set at an angle to the trailing surface, to enhance cutting action of the TSP and to enhance anchorage of the TSP material to the bit body. The TSPs may be set along a junction between the trailing surface and a rotationally leading surface of a trailing end of the gage pad. The TSPs may also be set along a junction between a radially outer surface of a gage pad and its adjacent longitudinally trailing surface. Thus, in some embodiments the protective structures also comprise cutting structures operable at least during directional drilling and up-drilling.

In various embodiments, TSPs may be set in a tracking pattern (one following another in the direction of intended bit rotation) or in a staggered pattern.

Optionally, TSPs may be used in conjunction with PDC cutting elements used for up-drilling to furnish enhanced protection for the relatively more fragile and expensive PDC cutting elements.

Another embodiment of the present invention comprises a rolling cutter rotary drill bit having a transition surface on the bit body extending on the legs carrying the rolling cutters to the radially outer extent of the legs, a plurality of TSPs being secured to at least one of the transition surfaces.

Further embodiments of the present invention comprise hybrid bits and other drilling tools, including reaming tools, having transition surfaces with protective elements placed in accordance with the present invention.

In some embodiments, protective structures in the form of non-diamond structures, such as carbide inserts (bricks, discs, etc.), ceramic inserts, or cubic boron nitride (CBN) desirably in the form of polycrystalline boron nitride (PCBN) inserts may be substituted for TSPs for wear protection or cutting. In some instances, non-diamond structures may be used as cutting structures in addition to TSPs at a greater exposure than the TSPs for casing exit drilling or other applications where ferrous metal components may be encountered prior to encountering a subterranean formation.

In some embodiments, TSPs, other protective structures, or both, may be cast in place during infiltration of a matrix-type bit, being placed in the bit mold prior to disposition of tungsten carbide or other hard particles therein, followed by infiltration with a copper alloy or other binder. TSPs may be coated with one or more metal layers to enhance bonding with the bit matrix. In other embodiments, the TSPs or other protective structures may be secured to a trailing surface by brazing at least partially within a suitably sized and shaped recess or by hardfacing. Coated TSPs may also be used to enhance the bond to the bit body through the intermediate bonding material, rather than merely holding the TSPs mechanically. Protective structures may also be mechanically pressed into recesses formed at desired locations.

DETAILED DESCRIPTION

Figure 1:
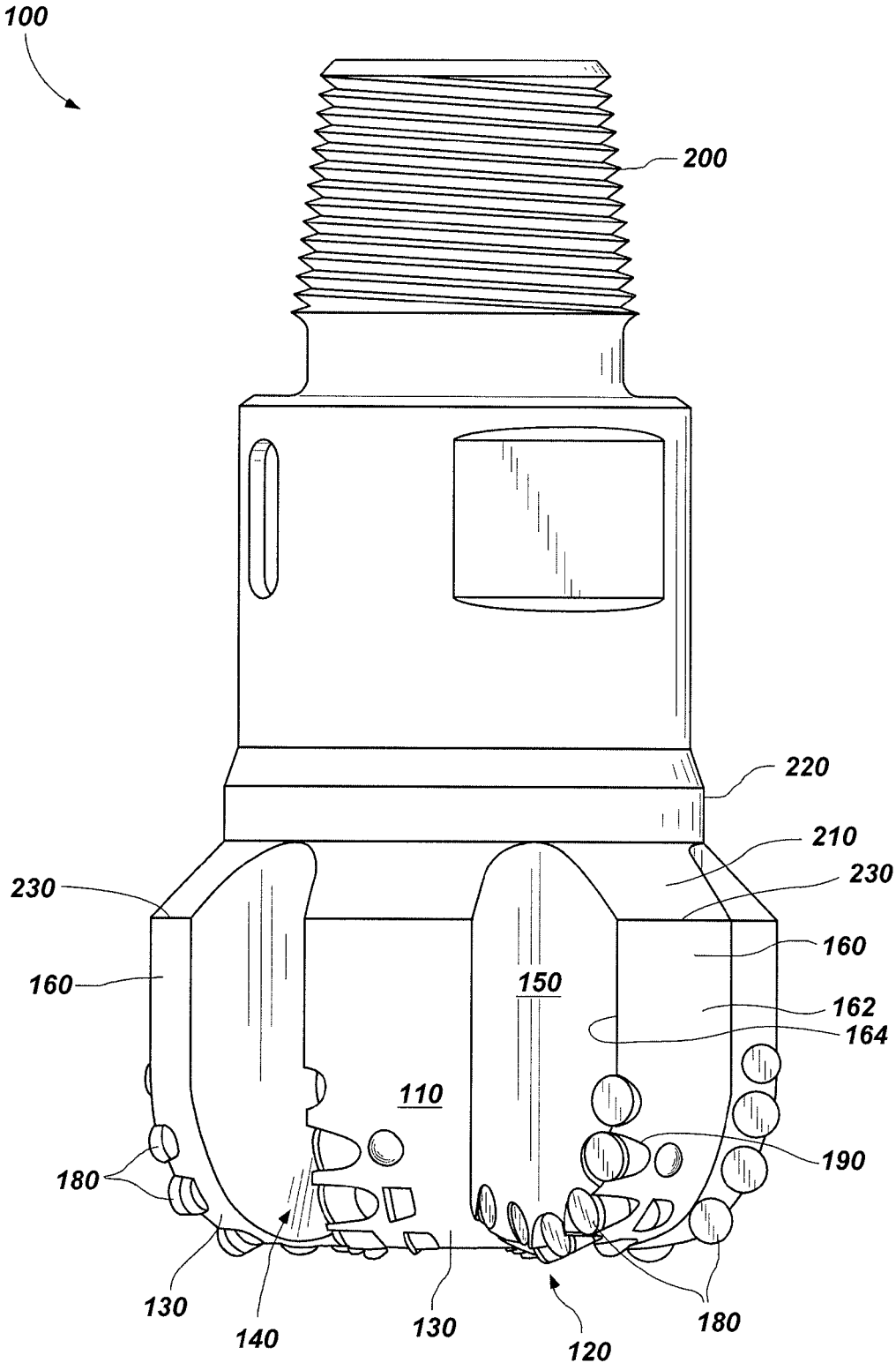
FIG. 1 (PRIOR ART)
FIG. 1 is a side elevation view of a conventional, fixed-cutter rotary drill bit.

In the description that follows, reference numerals employed with respect to a conventional fixed cutter rotary drill bit 100 have been used to designate the same or similar features with respect to embodiments of rotary drill bits and other drilling tools of the invention in order to facilitate an understanding of these embodiments.

Figure 2:
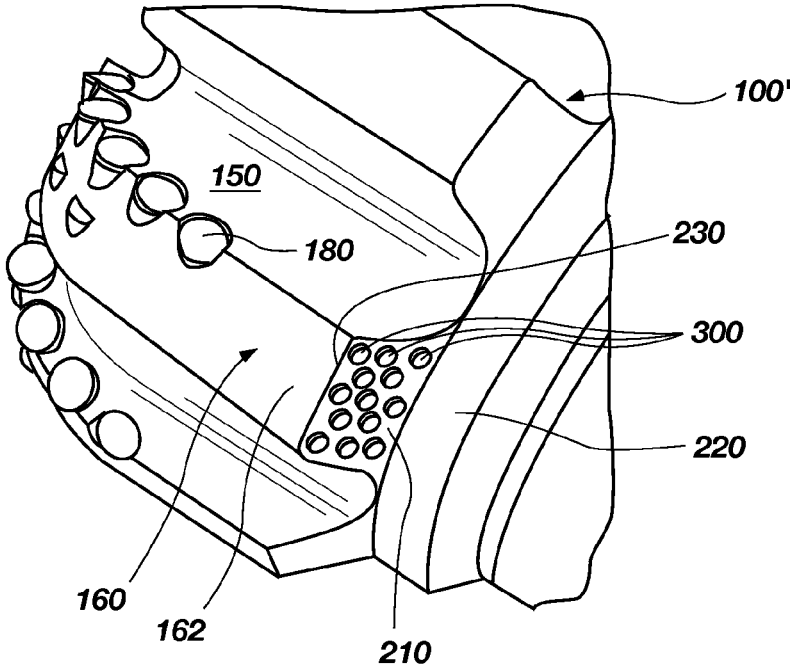
FIG. 2 is an enlarged perspective view of a portion of a fixed-cutter rotary drill bit having TSPs set in a staggered pattern in a trailing surface of a gage pad according to an embodiment of the invention.
Figure 2A:
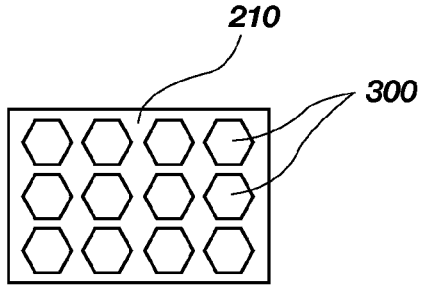
FIG. 2A is an elevation view of a trailing surface of a gage pad having TSPs set in a tracking pattern according to an embodiment of the invention.

Referring to FIG. 2 of the drawings, rotary drill bit 100' of the type depicted in FIG. 1 and comprising a plurality of gage pads 160 may be configured in accordance with an embodiment of the present invention to include protective structures in the form of a plurality of TSPs 300 set in a trailing surface 210, which may also be termed an "updrill ring," of at least one gage pad 160, TSPs 300 as depicted comprising disc-shaped thermally stable polycrystalline diamond masses. As shown, TSPs 300 have been furnaced into trailing surface 210 of rotary drill bit 100', which comprises a matrix-type drill bit, during infiltration of the bit body, such a process being well known in the art. TSPs 300 are pre-set in the bit updrill ring area of the mold cavity prior to disposition of tungsten carbide hard particles therein, followed by infiltration of the particles using a molten binder, such as a copper alloy. TSPs 300 may, optionally, be coated with one or several layers of metal to facilitate metallurgical bonding thereof with the bit body, in accordance with U.S. Pat. Nos. 4,943,488 and 5,049,164, the disclosure of each of which is incorporated herein by this reference. As depicted in FIG. 2, the TSPs 300 are set in a staggered pattern with rows of TSPs 300 offset in a lateral, or radial, direction from adjacent rows, to provide full coverage and protection of trailing surface 210 in the direction of bit rotation. However, it is also contemplated that TSPs 300 may be set in a linear, tracking pattern, one behind another in a row in the direction of bit rotation, areas of a trailing surface 210 between rows being devoid of TSPs as depicted in FIG. 2A so that grooves are created in trailing surface 210 after wear to enhance backedge aggressivity.

Figure 3:
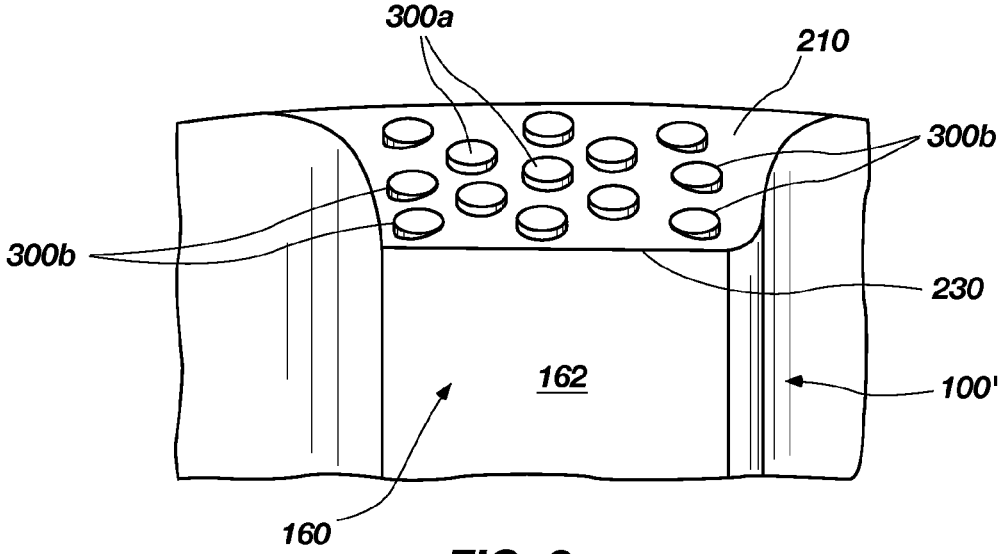
FIG. 3 is a greatly enlarged perspective view of a portion of the fixed cutter rotary drill bit of FIG. 2 including a gage pad and a trailing surface thereof having disc-shaped TSPs set therein at varying levels of exposure above the trailing surface.

Referring to FIG. 3 of the drawings, the trailing surface 210 of a gage pad 160 of a rotary drill bit 100' configured according to another embodiment of the present invention may be seen to comprise TSPs 300 at different levels of exposure, with TSPs 300*a* in a central region of trailing surface 210 being at a greater exposure than TSPs 300*b* closer to the rotationally leading and trailing edges of trailing surface 210. It may also be seen that TSPs 300*b* are set at a slight angle to trailing surface 210 at their respective locations for enhanced aggressivity.

Figure 4:
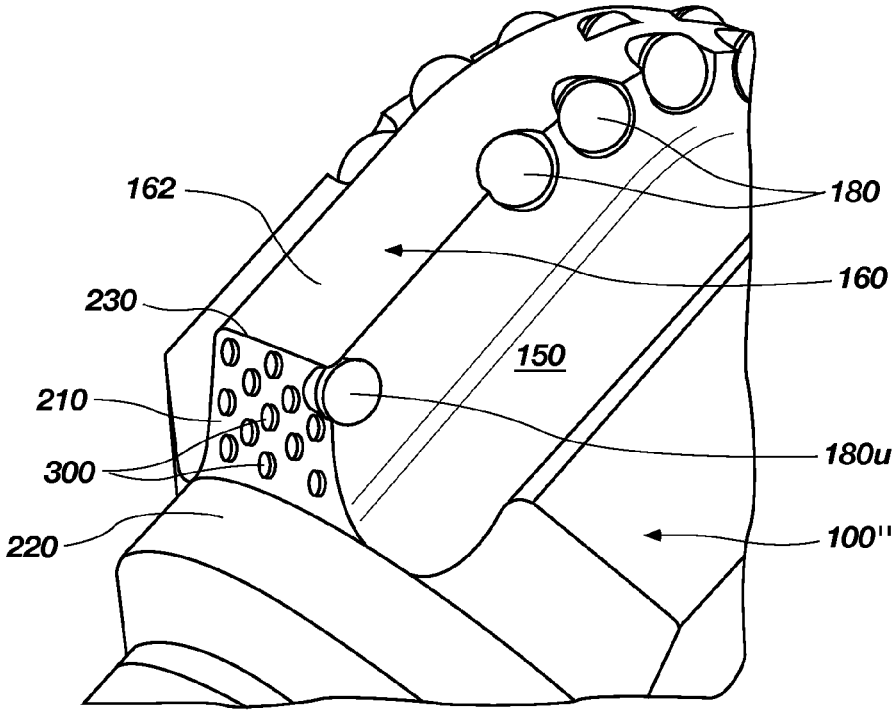
FIG. 4 is an enlarged perspective view of a portion of a fixed-cutter rotary drill bit having a PDC cutter set in one arrangement at a junction between a radially outer surface of a gage pad and a trailing surface thereof at a rotationally leading edge of the gage pad, the trailing surface having TSPs set therein for enhanced protection of the PDC cutter and reduced wear of the trailing surface.

Referring to FIG. 4 of the drawings, yet another rotary drill bit 100", similar in configuration to rotary drill bit 100, is depicted, with a PDC cutting element 180*u* set proximate the juncture between radially outer surface 162 of a gage pad 160 and a trailing surface 210 thereof, rotationally preceding transition edge 230. The PDC cutting element 180*u* provides an enhanced up-drill capability, while TSPs 300 rotationally trailing PDC cutting element 180*u* provide a degree of impact protection to PDC cutting element 180*u* as well as wear protection for trailing surface 210. Of course, more than one PDC cutting element 180*u* may be employed per gage pad 160. TSPs 300 may be placed so that some or all of the TSPs 300 rotationally precede a PDC cutting element 180*u*, as depicted in FIG. 4A.

Figure 4A:
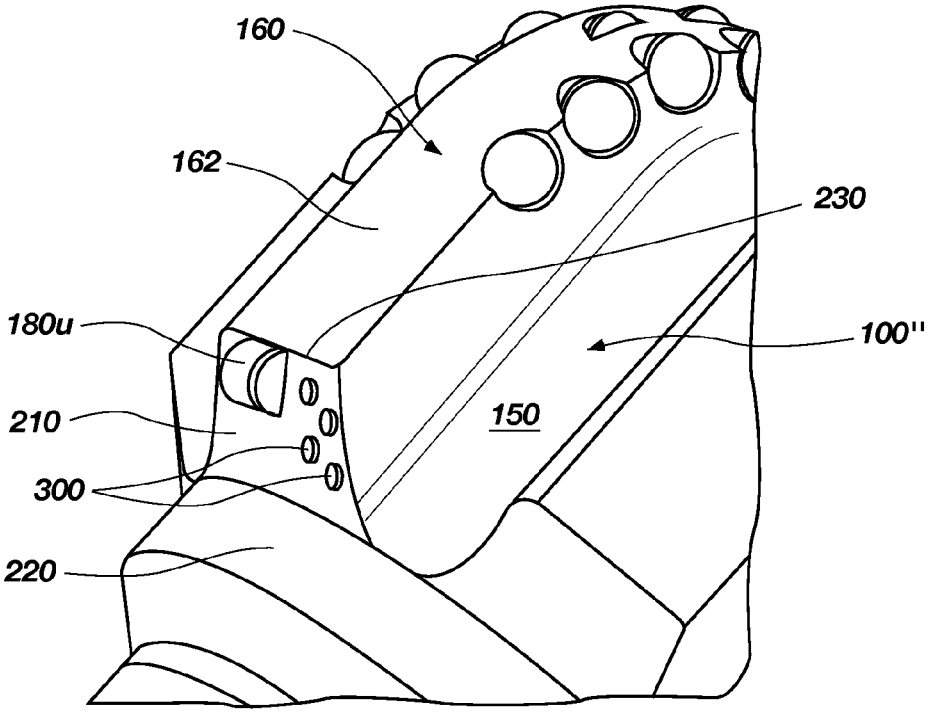
FIG. 4A is another enlarged perspective view of a portion of a fixed-cutter rotary drill bit having a PDC cutter set in another arrangement at a junction between a radially outer surface of a gage pad and a trailing surface thereof at a rotationally leading edge of the gage pad, the trailing surface having TSPs set therein for enhanced protection of the PDC cutter and reduced wear of the trailing surface.
Figure 5:
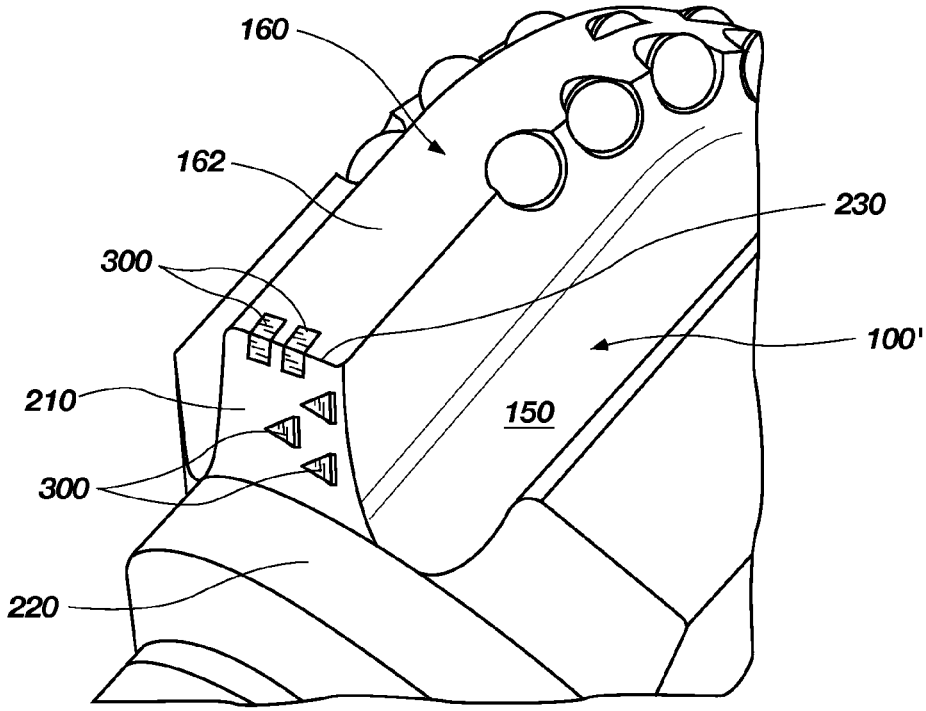
FIG. 5 is an enlarged perspective view of a portion of a fixed cutter rotary drill bit having TSPs set at a junction between a radially outer surface of a gage pad and a trailing surface thereof, the trailing surface also having TSPs set therein for reduced wear of the trailing surface, the latter TSPs being set at an acute angle to the trailing surface.

TSPs 300 may be set substantially flush with the trailing surface 210 as depicted in FIG. 4A, rather than being exposed as depicted in FIGS. 2 through 4. Moreover, various shapes of TSPs, such as disc (FIGS. 2, 3, 4, and 4A), as well as rectangular (FIGS. 5, 6, 7 and 8), triangular (FIG. 5), hexagonal (FIG. 2A), and other symmetrical and asymmetrical polygonal shapes, may be employed, a single shape or a combination of shapes being contemplated. A TSP may be especially shaped and placed at the junction of a radially outer surface 162 of a gage 160 and the trailing surface 210 thereof to protect both surfaces simultaneously, again as depicted in FIG. 5, wherein cuboidal TSPs 300 are placed at the junction. TSPs 300, in this case triangular TSPs 300, may be set in trailing surface 210 with their outer surfaces at an acute angle thereto, also as shown in FIG. 5, to enhance cutting action and also the anchorage of the TSPs 300 to the bit body.

Figure 6:
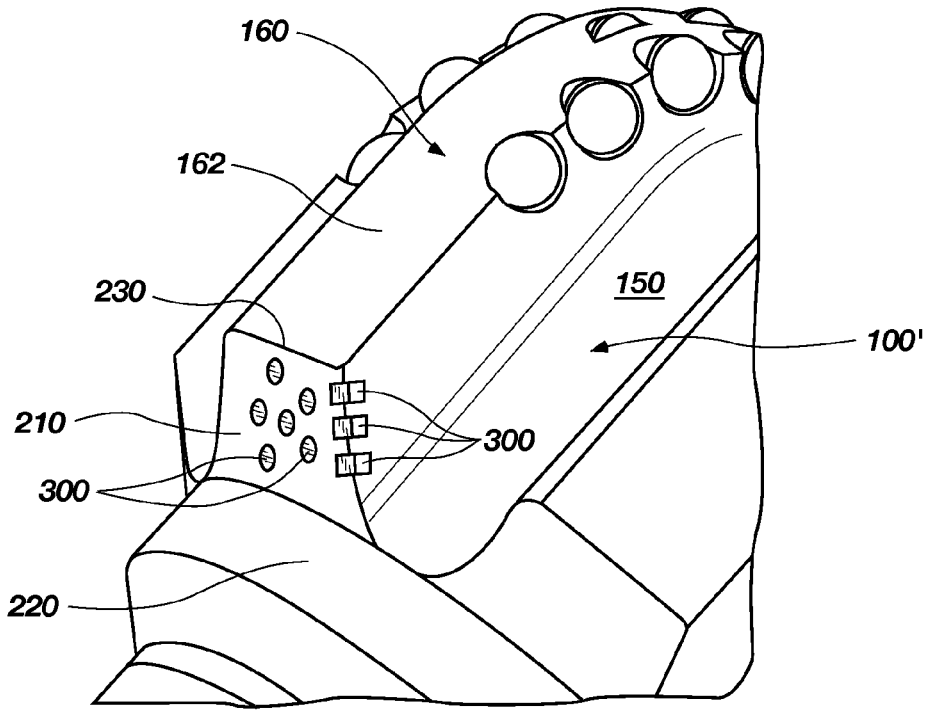
FIG. 6 is an enlarged perspective view of a portion of a fixed cutter rotary drill bit having a plurality of TSPs or other, non-diamond protective structures set at a junction between a trailing surface of a gage pad and a rotationally leading surface of the gage pad, the trailing surface also having TSPs set therein for enhanced protection of the PDC cutter and reduced wear of the trailing surface.

If exposed, TSPs 300 may, for example, be set to exhibit an exposure of up to about 0.25 inch, or about 0.635 cm. In addition, suitably configured TSPs 300, for example, cuboidal TSPs 300, may be set in recesses at the junction of a rotationally leading surface at the trailing end of a gage pad 160 and TSPs 300 of the same or another shape (disc-shaped TSPs 300 shown) adjacent trailing surface 210, to provide a cutting capability as well as wear protection for the trailing surface 210, as depicted in FIG. 6. Of course, such TSPs 300 may be exposed above the trailing surface 210, as shown in the case of the cuboidal TSPs 300, to enhance the cutting action, or may be set flush with trailing surface 210 as in the case of the disc-shaped TSPs 300.

Rather than being cast into a bit body, TSPs 300 may be secured to the body of a matrix-type bit, of a steel body bit or of a sintered particle body bit by, for example, a braze or a hardfacing material. Such an approach lends itself to repair of bits having gage pads with worn trailing ends, as well as to retrofitting existing bits with TSPs. The aforementioned metal-coated TSPs may be especially suitable for such applications due to the metallurgical bonding provided by the coating. However, mechanical bonding of the TSPs may also be effectively utilized, provided the body material, braze alloy or hardfacing is placed to grip appropriate surfaces and edges of the TSPs.

If it is contemplated that a rotary drill bit is to be used for casing exit drilling or drilling of other steel components downhole in conjunction with subterranean formation drilling, TSPs 300 may be substituted for by use of tungsten carbide inserts, ceramic inserts, or CBN or PCBN structures, all of which are non-reactive with steel and other ferrous metals. The reference numeral 300 thus, may also be used to designate non-TSP, non-diamond protective structures. Optionally, such non-reactive structures may be used in combination with TSPs and placed to exhibit a greater exposure than the TSPs for protection during an encounter with a steel component. This approach is illustrated in FIG. 6, wherein in one embodiment cuboidal protective structures 300 may comprise, for example, tungsten carbide, ceramic inserts, or PCBN structures, while round protective structures 300 may comprise TSPs.

It will be understood and appreciated by one of ordinary skill in the art that the present invention finds utility in all types of drag bits and fixed cutter drilling tools, and is not limited to bits employing PDC cutting elements for drilling, reaming, or both. By way of non-limiting example, bits employing non-diamond superabrasive cutting structures (e.g., cubic boron nitride), natural diamond cutting structures, TSPs, and diamond-impregnated matrix cutting structures (whether preformed or cast into a bit at time of manufacture), and combinations thereof, may be configured with various embodiments of the present invention.

While described in the context of fixed cutter rotary drag bits, such term including full-diameter bits, core bits, bi-center bits and eccentric bits, the present invention has utility in roller cone bits, so-called "hybrid" bits including both fixed cutting elements and rotating cones or other structures, and further including, without limitation, other drilling tools such as fixed-blade and expandable reamers. At least some, if not all, of the embodiments described herein may be employed in rolling cutters as well as hybrid bits on one or more transition surfaces extending on the bit body to the radially outer extent of the legs carrying the rolling cutters. As used herein, the term "rotary drill bit" includes and encompasses all of the foregoing rotary bits and tools.

Further, as used herein the term "shank' is not limited to male threaded structures used to connect a conventional drill bit to a drill string or bottom hole assembly, but encompasses other structures configured for a similar purpose. In addition, in the context of elongated downhole tools, such as, for example, reaming tools, which may have a conventional shank longitudinally separated from transition surfaces associated with reaming structure, the term shank broadly encompasses a tool portion of lesser diameter than a tool portion from which an associated transition surface extends radially inwardly.

In addition, protective structures of the present invention may be characterized as being set "proximate" a transition surface, another adjacent surface, or an edge or other junction therebetween. Such characterization includes protective structures having outer surfaces, edges, or both, flush with an adjacent surface of a bit or tool body portion, as well as protective structures having surfaces, edges, or both, exposed above, or "proud," with respect to an adjacent bit or tool surface.

Figure 7:
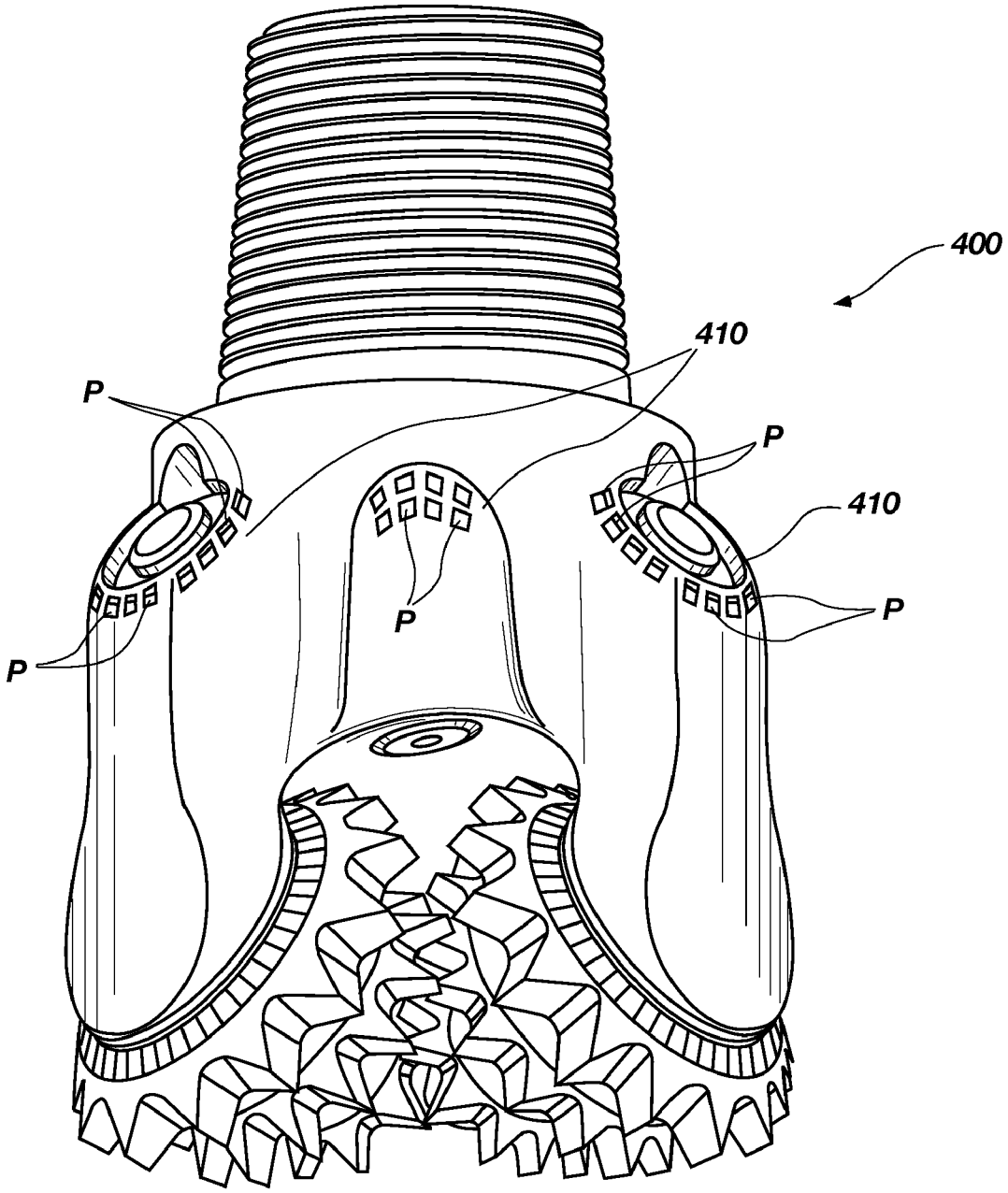
FIG. 7 is a perspective view of a drill bit including rotating cutting structures configured with protective structures according to embodiments of the present invention.
Figure 8:
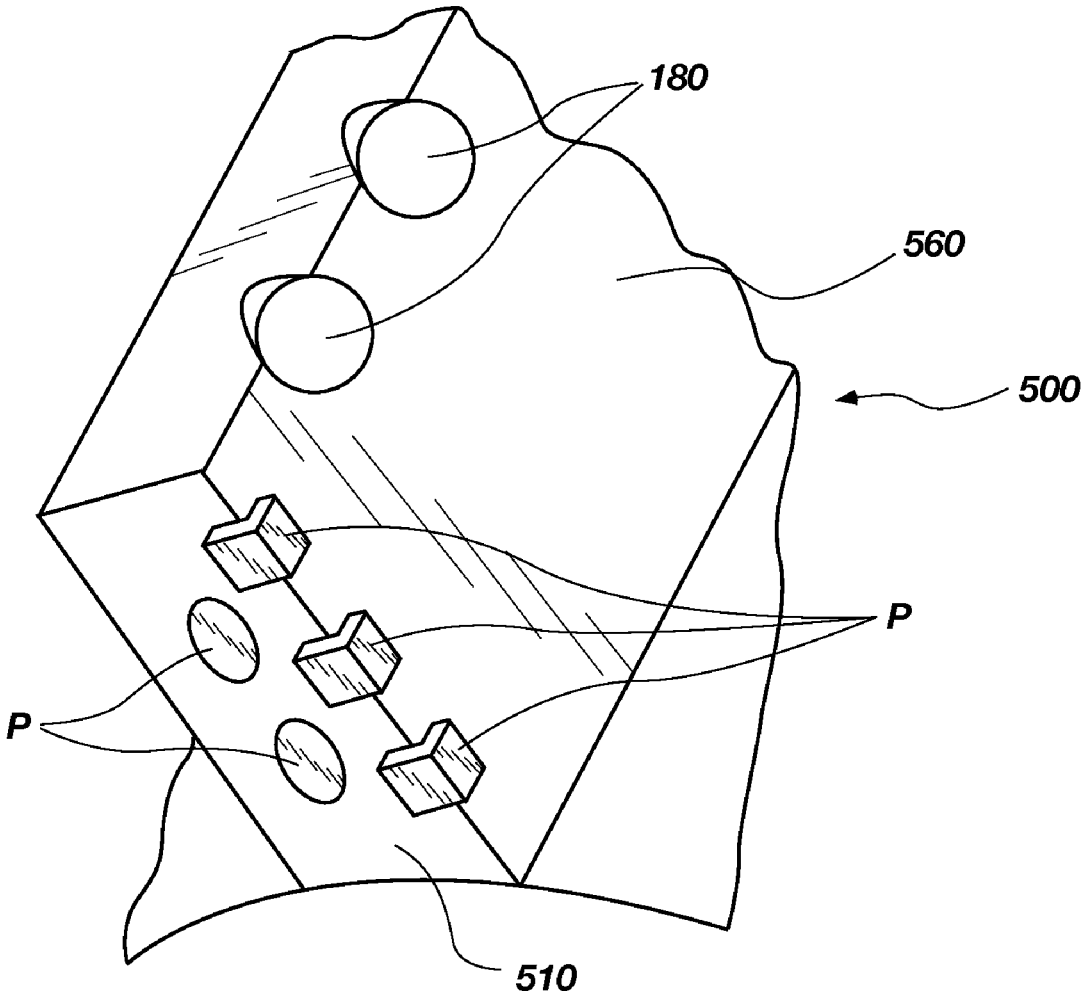
FIG. 8 is a perspective view of a portion of a drilling tool configured with protective structures according to embodiments of the present invention.

One such arrangement is depicted in FIG. 7, wherein generic protective structures P according to one or more embodiments of the present invention are designated as placed on roller cone or hybrid bit 400 on areas of transition surfaces 410. Similarly, as depicted in FIG. 8, generic protective structures P according to one or more embodiments of the present invention are designated as placed on a drilling tool 500, including without limitation a fixed-blade or expandable reamer, on areas of transition surfaces 510 of one or more blades 560. Such generic protective structures may comprise TSPs or a combination of TSPs and other materials as enumerated above.

While the present invention has been described with respect to certain embodiments, those of ordinary skill in the art will understand and appreciate that the invention is not so limited. Rather, combinations and variations of disclosed embodiments are encompassed by the present invention, which is limited only by the scope of the claims which follow, and their legal equivalents.

What is claimed is:

1. A rotary drill bit for subterranean drilling, comprising:

a bit body having a longitudinal axis and comprising, at a longitudinally leading end thereof, a plurality of blades extending over a face and carrying a plurality of cutting elements, at least some blades of the plurality of blades extending to a plurality of gage pads, and, at a longitudinally trailing end thereof, at least one juncture edge defined by at least one intersection between at least one transition surface extending radially inwardly along the longitudinal axis toward a shank and at least one gage pad of the plurality of gage pads; and a plurality of protective structures comprising a thermally stable polycrystalline diamond material positioned on the at least one transition surface, at least one of the protective structures being located at the at least one juncture edge and comprising:

a first portion positioned on the at least one transition surface; and at least another portion positioned on at the at least one gage pad.

2. The rotary drill bit of claim 1, further comprising at least one PDC cutting element located adjacent the at least one juncture edge, the at least one PDC cutting element rotationally preceding the plurality of protective structures.

3. The rotary drill bit of claim 1, wherein the bit body comprises a matrix-type bit body, and the plurality of protective structures is secured in a plurality of recesses in the at least one trailing surface.

4. The rotary drill bit of claim 1, further comprising at least one PDC cutting element disposed adjacent the at least one juncture edge, a cutting face of the at least one PDC cutting element rotationally following the plurality of protective structures.

5. The rotary drill bit of claim 1, wherein at least one protective structure of the plurality of protective structures has a level of exposure above the at least one trailing surface different than a level of exposure above the at least one trailing surface of at least another protective structure of the plurality of protective structures.

6. The rotary drill bit of claim 1, further comprising at least another protective structure secured to and exposed above the at least one trailing surface and comprising a non-diamond structure, wherein the non-diamond structure is exposed above each protective structure of the plurality of protective structures comprising the thermally stable polycrystalline diamond material.

7. The rotary drill bit of claim 1, wherein at least one protective structure of the plurality of protective structures is positioned at a junction of the at least one trailing surface and a rotationally leading surface of an associated gage pad, and wherein at least a portion of the at least one protective structure of the plurality of protective structures is positioned on the at least one trailing surface and at least another portion of the at least one protective structure of the plurality of protective structures is positioned on the rotationally leading surface.

8. The rotary drill bit of claim 1, wherein the at least one protective structure of the plurality of protective structures is exposed above the at least one trailing surface.

9. The rotary drill bit of claim 1, further comprising at least another protective structure secured to the at least one transition surface and comprising a material non-reactive with ferrous metals.

10. The rotary drill bit of claim 1, wherein the plurality of protective structures is metallurgically secured to the at least one transition surface.

11. The rotary drill bit of claim 1, further comprising another plurality of protective structures comprising non-diamond structures disposed on the at least one transition surface.

12. A rotary drilling structure for subterranean drilling, comprising:

a body having a plurality of gage pads or legs, at least one gage pad or leg of the plurality of gage pads or legs comprising a trailing surface extending at a longitudinally trailing end of the body radially inwardly at an oblique angle to a body structure of a smaller diameter, wherein at least one of a rotationally leading surface and a radially outer surface of the at least one gage pad or leg of the plurality of gage pads or legs intersects the trailing surface to form a junction edge; and at least one protective structure secured to the at least one gage pad or leg of the plurality of gage pads or legs at the junction edge, wherein at least a portion of the protective structure is positioned on the trailing surface and at least another portion of the protective structure is positioned on the radially outer surface.

13. The rotary drilling structure of claim 12, further comprising:

at least one other element selected from the group consisting of tungsten carbide inserts, ceramic inserts, and PCBN secured to the trailing surface proximate the at least one protective structure.

14. The rotary drilling structure of claim 13, wherein the at least one other element is exposed to a greater extent than the at least one protective structure.

15. The rotary drilling structure of claim 12, wherein the at least one protective structure comprises a plurality of protective structures, wherein at least one protective structure of the plurality of protective structures has a level of exposure above the trailing surface different than a level of exposure above the trailing surface of at least another protective structure of the plurality of protective structures.

16. The rotary drilling structure of claim 12, wherein the at least one protective structure comprises a thermally stable polycrystalline diamond.

* * * * *